United States Patent [19]

Grewell

[11] Patent Number: 4,736,801

[45] Date of Patent: Apr. 12, 1988

[54] CHIMNEY FIRE EXTINGUISHER

[76] Inventor: Roy A. Grewell, 1120 Cleveland St., Port Townsend, Wash. 98368

[21] Appl. No.: 759,752

[22] Filed: Jul. 29, 1985

[51] Int. Cl.[4] ..... A62C 23/00

[52] U.S. Cl. ..... 169/52; 169/54; 169/70; 239/123; 239/288.3; 239/550; 239/553.3; 239/554; 239/567; 239/DIG. 13

[58] Field of Search ..... 169/51, 52, 54, 65, 169/70; 239/104, 123, 288.3, 550, 553.3, 554, 567, 288, 288.5, DIG. 13, 553; 166/222, 223, 241; 134/166 C, 167 C, 168 C, 169 C; 118/306, 317

[56] References Cited

U.S. PATENT DOCUMENTS

| | | | |
|---|---|---|---|
| Re. 31,495 | 1/1984 | Zublin | 239/550 X |
| 1,469,336 | 10/1923 | Rowley | 169/51 |
| 1,658,697 | 2/1928 | Wiesman | 166/223 X |
| 2,605,140 | 7/1952 | Bartling | 239/553.3 |
| 2,763,288 | 9/1956 | Tharp | 134/168 C |
| 3,361,364 | 1/1968 | Purtell | 239/288.5 |
| 3,797,746 | 3/1974 | Gray et al. | 239/288.5 |
| 4,393,941 | 7/1983 | Stevens | 169/70 |
| 4,442,899 | 4/1984 | Zublin | 239/DIG. 13 |

FOREIGN PATENT DOCUMENTS

| | | | |
|---|---|---|---|
| 2746781 | 5/1978 | Fed. Rep. of Germany | 134/166 C |

*Primary Examiner*—Andres Kashnikow
*Assistant Examiner*—Mary Beth O. Jones
*Attorney, Agent, or Firm*—William I. Beach

[57] ABSTRACT

A fire extinguisher has an elongated manifold for discharging water on a chimney fire and is protectively secured within an opened face cage. The top has a threaded opening for a connection to a water hose and pointed bottom end for a ram head. An elongated bore extending from the hose connection feeds water to a plurality of lateral channels with openings on the outside of the manifold. A plurality of spray nozzles mounted in the openings are arranged to discharge a spray mist from the nozzles peripherally about the chimney wall. When lowered or dropped within a chimney the manifold pointed end penetrates the ignited mass of creosote while spraying a water mist to quench the fire.

2 Claims, 2 Drawing Sheets

CHIMNEY FIRE EXTINGUISHER

BACKGROUND OF THE INVENTION

1. Field of the Invention.

The present invention relates to extinguishing devices for suppressing chimney fires and more particularly water discharging nozzle devices.

2. Description of the Prior Art.

A novelty search disclosed very little art relating to the field of the present invention. Of the two references found, one was a U.S. Pat. No. 4,393,941 issued to Barry A. Stevens for Chimney Fire Snuffer. This device is a cylindrical body terminating in a bottom tapered end. An opening is provided in the top end for a connection to a garden hose coupling. Extending from the opening downwardly is a longitudinal bore supplied with water from the hose. The water from the bore is supplied through laterally extending bores to a plurality of small nozzles secured therein. The water is then discharged out of the nozzles in a fine flow.

Steven's snuffing device appears to have built-in features that would present problems in manufacturing, costs and actual effective use in snuffing chimney fires. It is noted that a secondary hose coupling is required to connect the snuffer to a coupling on the end of a garden hose. There are eight discharge nozzles installed in the main cylindrical body. In light of considerable experience in fighting chimney fires, it appears that there are too many nozzles installed in the body of the snuffer. There is no screening means used to filter out dirt particles in the water before reaching the nozzle orifice. The bottom cone is a separate unit that is drilled for a threaded connection to the main body which is likewise drilled and threaded at the bottom. A threaded plug is used to join the cone to the body.

The second reference relates to U.S. Pat. No. Re. 28,397 to J. A. Boyd titled Chute Sanitizer and Fire Extinguisher. This device also includes a cylindrical body tapered at the bottom end. Spray nozzles are recessed in the body for access to a source of water or chemicals. A water hose is connected to the body and also used to lower and raise the device in a trash chute usually found in apartment buildings. Boyd's device is too complicated for use in a chimney fire.

In consideration of the prior art it is the object of the present invention to provide an effective and efficient fire extinguishing nozzle with novel feature for solving the above mentioned problem inherent in the subject prior art.

SUMMARY OF THE INVENTION

In carrying out the principles of the present invention in accordance with a preferred embodiment thereof a chimney fire extinguisher can be lowered into a chimney to extinguish a fire. The extinguisher comprises a one piece, four sided manifold having a top and bottom end, the bottom end being a four sided extension tapering to a point of an approximate length of ¼ of the manifold overall length and including a threaded opening in the top end for a coupling to a garden hose. Included, also, is a removable adapter having a threaded male end mounted in the opening and an enlarged female end tapped and threaded for a coupling with a hose larger than the garden hose. Extending axially from the opening a bore terminates in a closed end adjacent to the extension for receiving water under pressure therein. There are at least four channels opening from the bore to threaded outlets, one of each disposed in one of the four sides of the manifold at 90° intervals, said channels being spaced along said manifold. Further, included are small spray nozzles having a shank portion threadly secured in each of the outlets and a head portion projecting outwardly thereof including a small orifice in communication with said channels to discharge a fine spray about the manifold. Mounted on each shank is a thimble-like screen adapted to prevent clogging particles from entering the orifice. The manifold is secured concentrically within a cage enclosure. The enclosure is a sectional structure for protecting the manifold The cage comprises two square, first and second metal frames forming a rectangular structure by four parallel metal struts connected thereto. Included is a third smaller square frame linked in space alignment to the first frame and a fourth square frame smaller than the third frame likewise being linked to the second frame. Further, the third and fourth frames are linked to the first and second frames respectively by at least four sloping metal struts thereby forming spaced tapered sections connected to the first and second metal frames. The hose-connected manifold is transported by ladder to the chimney top and manually dropped therein until the pointed end penetrates the creosote mass sufficiently to allow the discharge of fine water mist to extinguish the fire.

DETAILED DESCRIPTION OF THE PRESENT INVENTION

Figure 1:
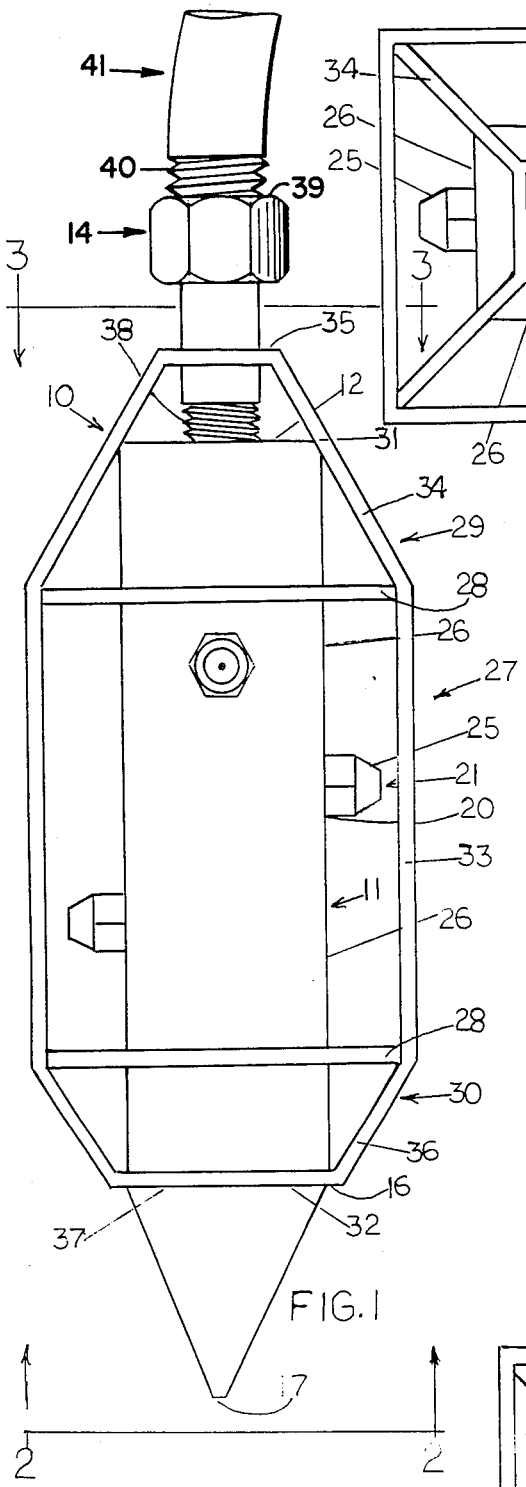
FIG. 1 is an elevated view of the present invention showing a water discharging manifold with a tapered pointed bottom and an adapter threadly connected at the top enclosed in a protective cage.
Figure 3:
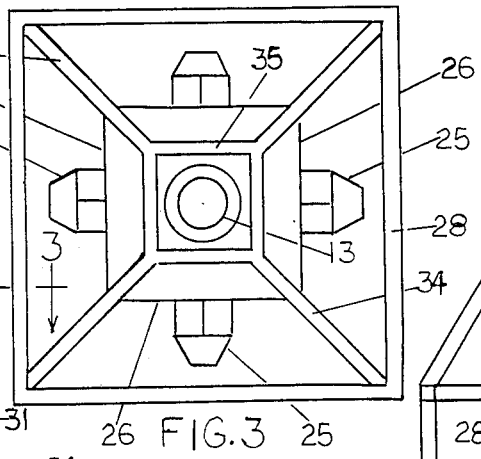
FIG. 3 shows an upper view taken along lines 3—3 of FIG. 1.
Figure 4:
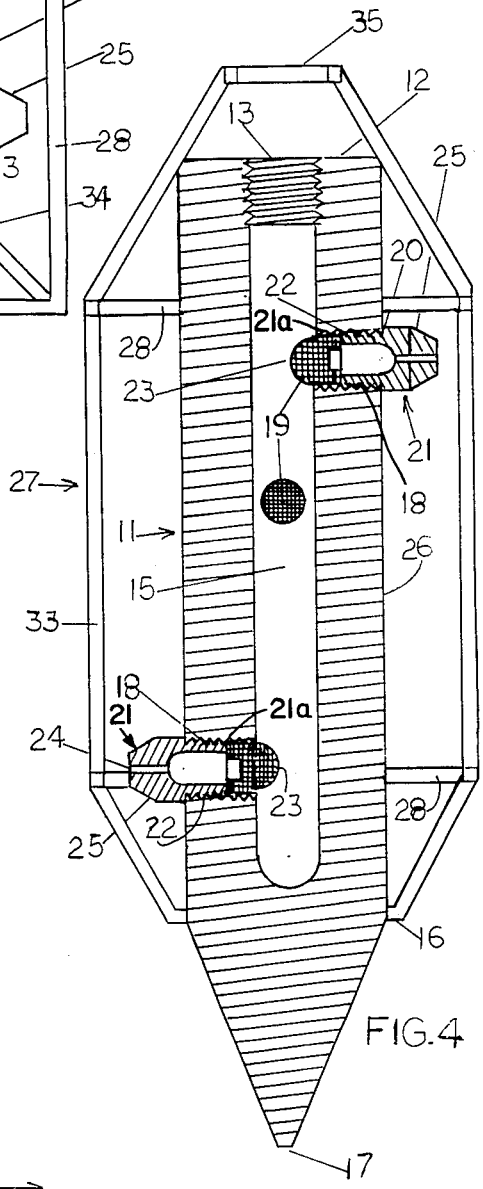
FIG. 4 shows a vertical section view taken along line 4—4 of FIG. 2.
Figure 2:
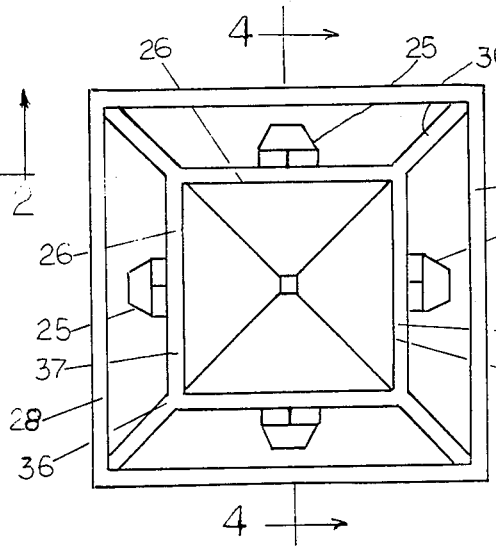
FIG. 2 shows a view from the bottom taken along line 2—2 of FIG. 1.
Figure 5:
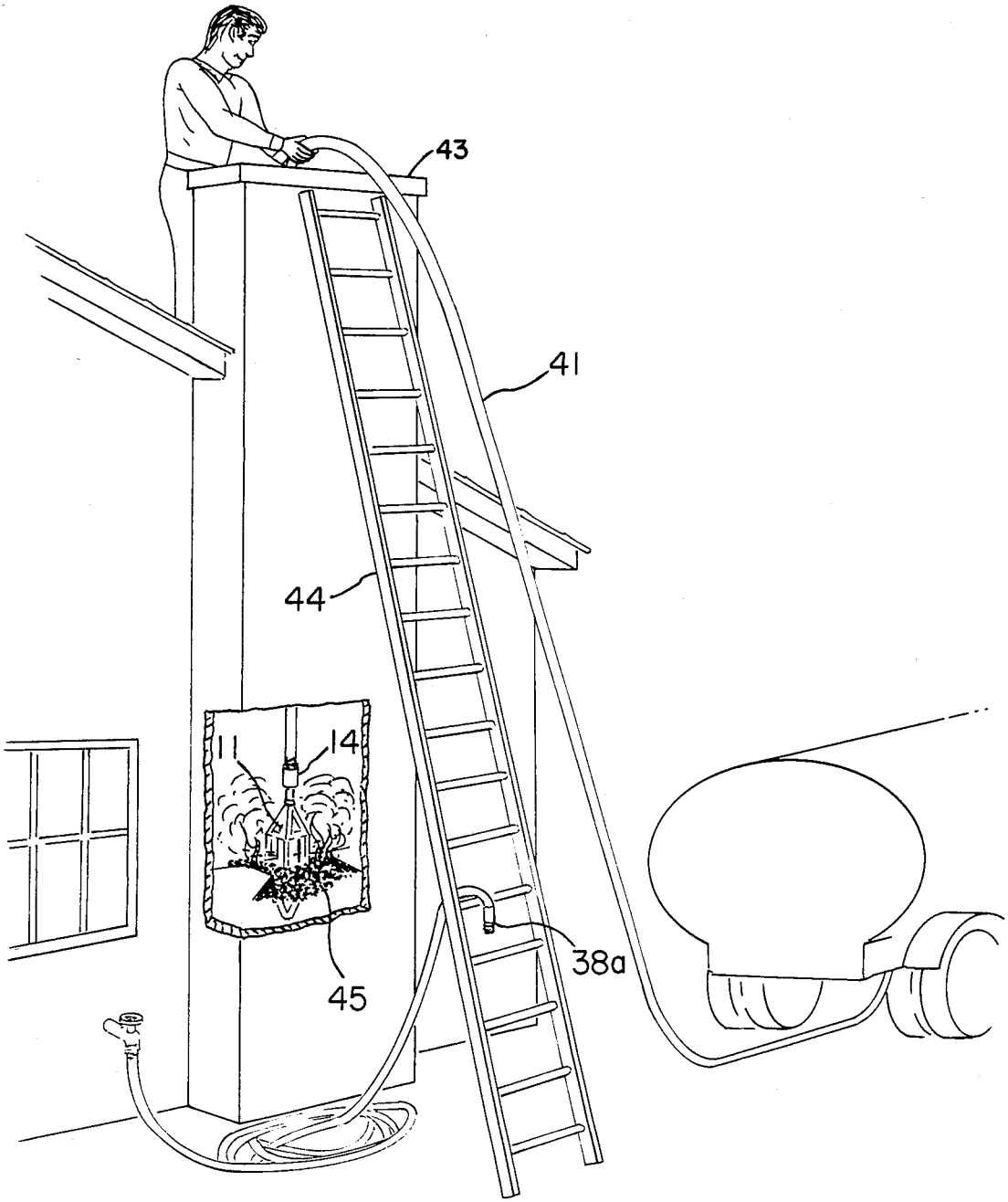
FIG. 5 shows the procedure of lowering the manifold down a chimney to penetrate and quench a creosote fire.

Referring to FIG.'s 1-4 it can be seen that the fire extinguisher 10 of the present invention is essentially a wedge-shaped manifold enclosed in a cage. It was conceived and developed for fire service to assist fire fighters in the suppression of creosote type fires within chimneys. The manifold 11 is a metal assembly machined as a wedge or as a ram head device with a pointed nose section for penetrating heavy masses of creosote, the primary causes of chimney fires. Manifold 11 is a square sectional bar which is drilled on the top 12 for a taped threaded hole 13 for receiving within a conventional garden hose coupling. Hole 13 can be made to mate with a larger size hose coupling by enlarging the threaded opening. However, universal household use for the general public is preferable where a standard lawn hose is available. Therefore, while hole 13 can be threadedly attached to a lawn hose it can also be connected to a larger hose by use of an adapter 14. Adapter 14 is a short piece of pipe having a male end threaded for engagment with hole 13 and the opposite female end threaded for a 1" booster hose commonly used by firemen to suppress chimney fires. The booster hose is the standard rubber hose normally pre-connected to the fire truck. A chimney fire can get very hot to the extent that a common lawn hose may disintegrate and become ineffective. It has been demonstrated that following the quenching of a particularly hot fire the booster nozzle when cooled in a bucket of water sets the water to boiling. It should be understood that hole 13 and adapter 14 can be varied to mate with any practical size hose commensurable with the cross-sectional dimmension of the manifold. Included in hole 13 is a relatively small bore 15 to provide a water channel from the hole 13 downwardly for a length 16 where the square are of the manifold changes from a square to a tapered bottom point 17. The tapered point 17 along with weight of manifold 11 is important to be able to penetrate and smother a creosote fire. It has been found that a manifold weight of approximate 9 pounds is satisfactory for penetrating a creosote pocket adhering to the interior walls of a chimney. From the bore 15 water under pressure is forced through a plurality of small channels 18 preferably four leading off of the bore to threaded outlets 20, one of each being disposed in one of the four sides of the manifold 11 at 90° intervals, and the channels being spaced along the manifold for approximately equal distances 19 apart. Again as a result of experimental trials in testing the fire extinguisher 10 of the present invention four water outlets 20 were sufficient to suppress a hot chimney fire. For example, extinguisher 10 provides water under pressure in the form of a mist discharged through a small orifice in nozzle 21 which when lowered into a chimney mixes with the heat of the fire. The mixture creates steam which in turn suppresses the fire gradually. This is an important feature of the present invention because the fire service test indicated that a larger quantity of water spray provided by more than four outlets from the manifold tended to create too rapid a cooling resulted in some damage to the chimney. This results in severe cracking of the liners, brick, morter and cinder block assemblies. Further, too much water spray not adequately absorbed in steam runs down into the fire place and may cause considerable damage to the interior of the building. In view of the aforegoing, four jet type nozzle tips 21 with threaded shank 22 is secured within the outlets 20. On the inner end of shank 22 is attached a screen 23 for straining out harmful particles of dirt present in water that may plug the nozzle tip 21. The four tips 21 have individual orifices 24 which atomizes water and also provides a fixed rate of water flow in gallons per hour. The size of tips tested were 12, 16 and 20 g/p.h. and found to produce desired results under a wide range of chimney fire conditions. The nozzle tips 21 are installed in outlets 20 with the head portion 25 extending outside of the sides 26 of the manifold 11 to permit a wider range spray. Recessing the tips within the outlet, and even if the face of the head 25 is flush with the outside surface of the opening 20, the side range of spray would not be as wide as the head being outside of the outlet. Another factor in consideration was the possibility of damaging the recessed tips during the insertion and retraction of the fire extinguisher in the chimney. In lowering the extinguisher one side of the other frequently will be scraped along the walls which project sharp pieces of mortar between the bricks. The possibility of mortor damage to the recessed nozzle tip is constantly present in handling a chimney fire. Furthermore, another problem exists in penetrating heavy creosote, tar, resin, and other waste products from burning solid fuel build-up in the chimney. The viscosity of creosote can make the mass gummy and when the recessed tips are passing through the mass there is little outward space to discharge an effective spray. Also, the orifice can be temporarily clogged and become non-operational. Obviously, it is preferable that the outward extending nozzle tip of the present invention be protected of damage. Hence, a cage enclosure 27 is secured to manifold 11 adjacent to the top 12 and bottom 16. The cage enclosure 27 is constructed in a torpedo-like structure to protect and facilitate progress of the extinguisher along the rough surface of the chimney wall.

This is achieved by cage 27 reference FIG. 1 which has a central section **27*a* that has opposite square end frames 28 secured to a pair of spaced tapered sections 29 and 30. As previously mentioned, the upper end portion 31 of section 29 is secured to top 12 and the lower end 32 of section 30 to bottom 16 of manifold 11. The central section as can be seen in FIG.'s 3 and 4 have four spaced, parallel struts 33 connected to spaced square frame 28. Extending from a connection with the upper frame 28 is section 29 with four spaced, tapering struts 34 secured to a smaller square frame 35. Further, extending from a connection with the opposite square frame 28 is section 30 with similarly tapering struts 36 secured to a smaller square frame 37 that is smaller than frame 28, but larger than frame 35**.

The firefighting procedure with the extinguisher entail connecting the top hole 13 in the manifold to a lawn hose coupling **38*a* if handled by a home owner or to the smaller end 38 of adapter 14 and the other end 39 to threads 40 of a booster hose 41 connected to a fire truck 42 when attended by a fire fighting unit. The extinguisher is then transported to the top of a chimeny by ladder 44 and lowered strike and to penetrate the source of the fire 45** and discharge a sray of fine water mist on the burning mass of creosote adhering to the chimney wall. The volume and pressure of water spray when mixed with heat to form a blanket of steam is important in suppressing a chimney fire efficiently and effectively without creating damage to the extinguisher and more importantly to the building being served.

From the description and illustration of the present invention, it is obvious that it provides important advantages which can be employed to suppress a chimney fire.

The foregoing description is to be clearly understood to be given by illustration and example only, the spirit and scope of the present invention being limited solely by the appended claims.

I claim:

1. A fire extinguisher adapted to be lowered down a chimney to extinguish a creosote generated fire burning on the inside wall, which comprises:

a one piece, four sided manifold having a top and bottom end, the bottom end being a four sided extension tapering to a point of approximately ¼ of the manifold overall length, a top end opening tapped and threaded to receive a garden hose coupling, a removable adapter having a threaded male end mounted in the opening and the other end being an enlarged female end tapped and threaded for a coupling with a hose larger in diameter than the garden hose, a bore extending axially from said opening to a closed end adjacent to the extension for receiving water under pressure therein, at least four channels opening from the bore to threaded outlets, one of each disposed in one of said four sides of said manifold at 90° intervals, said channels being spaced along said manifold, at least four small spray nozzles having a shank portion threadedly connected in one of each of the outlets and a head portion extending outwardly thereof including a small orifice therethrough in communication with said channels, at least four thimble-like screens having an open end mounted on the shank end of one of each of the nozzles adapted to prevent clogging particles from entering the orifice, a protective cage mounted on said manifold comprising two square, first and second metal frames forming a rectangular structure by four parallel metal struts connected thereto, and including a third smaller square frame linked in spaced alignment to the first frame and a fourth square frame smaller than the third frame likewise being linked to the second frame wherein the third and fourth frames are linked to the first and second frames respectively by at least four sloping metal struts and forming spaced tapered sections connected to the first and second metal frames, and wherein said hose-connected manifold is manually dropped down said chimney until the pointed end penetrates a burning creosote mass adhering to the chimney wall sufficiently to allow discharge of a fine mist of water about said manifold to put out the fire.

2. A fire extinguisher adapted to be lowered within a chimney to extinguish a fire ignited by a mass of creosote deposited on the inside wall, which comprises, an elongated, heavy, one piece manifold having four sides, a top and bottom end and a four sided bottom extension tapering to a point of approximately $\frac{1}{4}$ of the manifold overall length, including an opening in the top tapped and threaded to couple with a garden hose end, an adapter having external threads on one end removably mounted in the opening and the other end enlarged, tapped and threaded to receive therein the threaded end of a hose larger in diameter than the garden hose, a bore extending axially from said opening to a closed end adjacent to the extension for receiving water under pressure therein, at least four channels opening from the bore to threaded outlets, one of each disposed in one of said sides of said manifold at 90° intervals, said channels being spaced along said manifold, a spray nozzle having a shank portion threadedly secured in one of each of the outlets and a head portion projecting outwardly thereof including a small orifice therethrough having access to the water flowing in said channels, a thimble-like screen having an open end mounted on the shank end of one of each of the nozzles to restrain particles of rust, calcium, and the like, from clogging the orifice, a protective cage mounted about said manifold comprising a central section defined by first lower and second upper square metal frames linked together at the corners with four parallel struts in a rectangular structure, a third smaller square metal frame linked in spaced alignment to the first frame including a fourth square metal frame, smaller than the third frame, also linked in spaced alignment to the second frame, each being connected thereto by four sloping metal struts forming spaced tapered sections connected to the opposite ends of the central section, wherein said hose-connected manifold is manually dropped down said chimney to penetrate the mass of burning creosote sufficiently to allow discharge of fine water mist to mix with the interior heat and form a blanket of steam to quickly smother the fire.

* * * * *